US008623147B2

(12) United States Patent
Hoffman et al.

(10) Patent No.: US 8,623,147 B2
(45) Date of Patent: Jan. 7, 2014

(54) METHOD FOR WAX REMOVAL AND MEASUREMENT OF WAX THICKNESS

(75) Inventors: Rainer Hoffman, Skien (NO); Lene Amundsen, Porsgrunn (NO)

(73) Assignee: Statoil Petroleum AS, Stavanger (NO)

( * ) Notice: Subject to any disclaimer, the term of this patent is extended or adjusted under 35 U.S.C. 154(b) by 708 days.

(21) Appl. No.: 12/738,574

(22) PCT Filed: Oct. 20, 2008

(86) PCT No.: PCT/NO2008/000371

§ 371 (c)(1),
(2), (4) Date: May 26, 2010

(87) PCT Pub. No.: WO2009/051495

PCT Pub. Date: Apr. 23, 2009

(65) Prior Publication Data

US 2010/0300486 A1 Dec. 2, 2010

(30) Foreign Application Priority Data

Oct. 19, 2007 (NO) ..... 20075366

(51) Int. Cl.
*B08B 9/00* (2006.01)

(52) U.S. Cl.
USPC ..... 134/22.1; 134/5; 134/19; 15/1

(58) Field of Classification Search
None
See application file for complete search history.

(56) References Cited

U.S. PATENT DOCUMENTS

| | | | |
|---|---|---|---|
| 3,454,464 | A | 7/1969 | Tuggle et al. |
| 3,764,517 | A | 10/1973 | Bodemuller, Jr. |
| 3,775,288 | A | 11/1973 | Eagen et al. |
| 4,911,240 | A | 3/1990 | Haney et al. |
| 6,070,417 | A | 6/2000 | Benson |
| 6,656,366 | B1 | 12/2003 | Fung et al. |

FOREIGN PATENT DOCUMENTS

| | | | |
|---|---|---|---|
| EP | 334578 | A2 * | 9/1989 |
| FR | 2804467 | A1 | 8/2001 |
| FR | 2900459 | A1 | 11/2007 |
| GB | 2 358 655 | A | 8/2001 |
| GB | 2437161 | A | 10/2007 |
| NO | 174068 | B | 11/1993 |
| NO | 319444 | B1 | 8/2005 |
| NO | 322636 | B1 | 11/2006 |
| NO | 324463 | | 10/2007 |
| RU | 2099632 | C1 | 12/1997 |
| RU | 2123393 | C1 * | 12/1998 |
| WO | WO 90/05266 | A1 | 5/1990 |
| WO | WO/2004/059178 | | 7/2004 |
| WO | WO 2006/075913 | A1 | 7/2006 |
| WO | WO 2010/087724 | A1 | 8/2010 |

OTHER PUBLICATIONS

Search Report dated Jan. 13, 2012 for Application No. GB1006092.9, 1 page.

* cited by examiner

*Primary Examiner* — Eric Golightly
(74) *Attorney, Agent, or Firm* — Patterson Thuente Pedersen, P.A.

(57) ABSTRACT

A method for removal of wax deposited on an inner wall in contact with a fluid stream. The method includes the steps of cooling the inner wall and the fluid stream to a temperature of or below the wax appearance temperature, enabling wax to dissolve and precipitate on the inner wall, and heating of the inner wall for a short period of time to release the deposited wax from the surface of the inner wall, mainly in the form of solid parts. The thickness of wax deposits in a pipe section can be determined by computing the temperatures obtained upstream and downstream in the said pipe section, before and after applying heat pulse.

17 Claims, 6 Drawing Sheets

METHOD FOR WAX REMOVAL AND MEASUREMENT OF WAX THICKNESS

PRIORITY CLAIM

The present application is a National Phase Entry of PCT Application No. PCT/NO2008/000371, filed Oct. 20, 2008, which claims priority to Norway Application Number 20075366, filed Oct. 19, 2007, the disclosures of which are hereby incorporated by reference herein in their entirety.

The present invention relates to a method for removal of solids that build-up in a system or conduit containing or conveying fluid. Especially, the present invention relates to a method for removal of wax from pipelines and other equipment used for the transport of hydrocarbons.

BACKGROUND OF THE INVENTION

Wax deposition at the inside wall of oil pipelines is a severe problem in today's oil production infrastructure: When warm oil flows through a pipeline with cold walls, wax will precipitate and adhere to the walls. This in turn will reduce the pipeline cross-sectional area leading without proper counter measures, to a loss of pressure, and ultimately to a complete blockage of the pipeline.

EXISTING TECHNOLOGIES THAT DEAL WITH THE PROBLEM INCLUDE

Pigging: Mechanical scraping off the wax from the pipe wall at regular intervals.

Chemical inhibition: Addition of chemicals which prevent wax deposition.

Direct Electrical Heating (DEH): Electric heating keeps the pipeline warm (above the wax appearance temperature).

Pigging is a complex and expensive operation. If no loop is available, a pig has to be inserted sub-sea using remote-operated vehicles. It is also a risky operation, as of today; there is no secure way of measuring/predicting the amount of wax deposited in the pipeline. This induces the risk that more wax is deposited than the pig diameter is designed for, resulting in a stuck pig.

Chemical inhibition is expensive due to the fact that an additional pipeline has to be built that supplies the chemicals to the wellhead and the chemicals themselves are expensive. Chemical inhibition is also inefficient as there are currently no chemicals available that completely reduce wax deposition. So there is always a need of additional pigging. Further the chemicals that are used are classified as environmentally very problematic.

Electric heating above the wax appearance temperature is very expensive due to both high installation and operational costs. Accordingly, electric heating is not feasible for long-distance transport.

Other known methods are described in the prior art, where:

U.S. Pat. No. 6,070,417 B1 discloses a method for making a slurry where solids are precipitated and removed mechanically from the surface on which they precipitated, by a runner or pig circulating in a lumen or loop.

U.S. Pat. No. 6,656,366 B1 describes a method for reducing solids build-up in hydrocarbon streams produced from wells. The described method is based on deposition by cooling and mechanical removal of the deposit, by using a runner as above or a helical coil mechanically removing deposits.

EP 334 578 describes the injection of a cold dewaxing solvent in scraping chillers for removing deposits.

With today's technology long-distance multiphase transport of waxy fluids is largely limited due to wax control. Pigging is not possible over such large distances and electric heating is limited by costs. Transporting wax as solid particles in a cold stream is a well-known idea which is under research by many groups (called 'cold flow' or 'slurry flow'). Cold flow is considered to be one of the promising candidates for circumventing this problem. The problem with cold flow is how to deal with wax in the cooling zone.

SUMMARY OF THE INVENTION

The intention of the present invention is to provide a new method for removal of wax deposits that is cost efficient both to install and operate, which is applicable for long-distance transport and which can be adapted for different situations. The solution proposed herein provides a way to mix waxy particles into the flow.

The present invention provides a method for removal of wax deposited on an inner wall in contact with a fluid stream, the method comprising cooling the inner wall and the fluid stream to a temperature of or below the wax appearance temperature, which will allow for dissolved wax to precipitate on the inner wall, wherein the method further comprises the heating of the inner wall for a short period of time to release the deposited wax from the surface of the inner wall, mainly in the form of solid parts.

Also the invention concerns a method comprising the further features wherein: said released solid parts are mixed into the stream; the heating temperature is close to or above the bulk flow temperature; wax is chosen of any from the group comprising: solids that precipitate from fluids due to thermodynamically changes, solids typically dissolved in crude oil at well bore conditions, asphaltenes, higher paraffins, hydrates, and inorganic and organic salts and any mixture thereof; the duration of the heating is a pulse heating long enough to release deposited wax, and which preferably is shorter than the precipitation step; the pulse heating is repeated at regular intervals, or repeated on demand, preferably according to a defined limit of wax thickness; the inner wall is the inner wall of a pipeline, the well itself, the well head, or any pipeline and top-side equipment used in the development or processing of hydrocarbons; the heating step is performed at different times for different sections of the pipeline or different equipment type; the inner wall is located in the ground, in sea water or inside a heat exchanger; the cooling of the inner wall is performed by natural convection with the surroundings or by a forced fluid stream in an annulus of a heat exchanger surrounding the inner wall; heating is performed by electrical heating, preferably by heating cables around the pipe, resistive heating or inductive heating in the pipe wall, or by a heat exchanger, preferably by letting a warm fluid pass through the heat exchanger; or wherein the apparatus containing said inner wall can be passed by a pig, such as a cleaning pig or inspection pig.

The invention also provides an apparatus for performing the methods above.

In addition, the invention provides a method for measuring the thickness of wax deposits in a pipe section or process equipment conducting a stream of hydrocarbons comprising the steps of:

(a) performing a first temperature measurement upstream and downstream of the pipe section;

(b) applying a short heat pulse to the pipe section which does not loosen the deposits;

(c) performing a second temperature measurement upstream and downstream of the pipe section;

(d) calculating the thickness of the deposits from the change in temperature difference between the first and second temperature measurements.

The invention also concerns a method comprising the further features wherein: the short heat pulse is shorter than the period of time needed to loosen the deposited wax; and the temperature measurements are chosen from: the temperature of the bulk flow, the temperature of the pipe wall, the temperature of a fluid flowing in an annulus around the pipe.

The invention also concerns a method for removal of wax deposited on an inner wall in contact with a fluid stream, wherein wax removal is performed according to the invention when a limit of wax thickness is reached, the wax thickness being measured according to the invention. Also a part of the invention is a further feature wherein wax thickness is measured regularly at predefined time intervals, which automatically initiates the removal method, the method preferably being controlled by an automated control, such as a computer.

Further the invention concerns the use of the methods and apparatus for cleaning inner walls of the equipment described.

DETAILED DESCRIPTION OF THE INVENTION

Wax Removal

Figure 1:
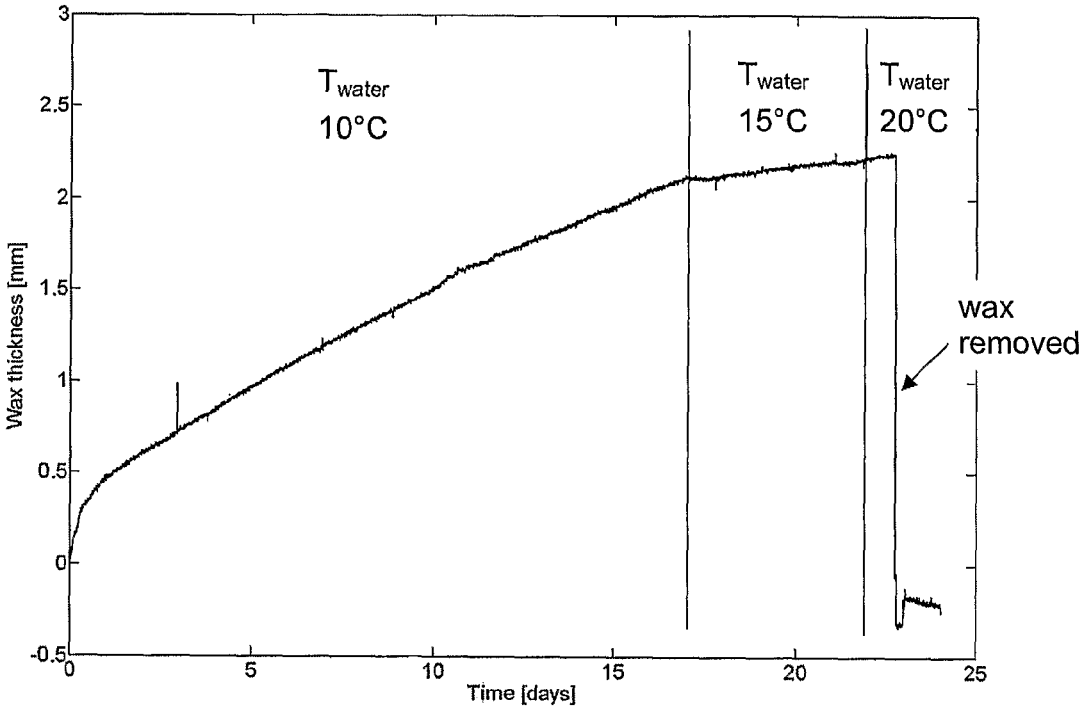
FIG. 1 is a graph of wax thickness over time with a change in temperature.

The fluid stream on which the present invention can be applied can be a single phase or multiphase stream comprising hydrocarbons and optionally $H_2O$ and/or gasses such as $CO_2$, $H_2S$ etc. and/or salts and/or additives such as different inhibitors. Advantageously the present invention can be applied to equipment transporting hydrocarbons.

The equipment may be any type of process equipment that is used to transport hydrocarbons, such as the well itself, the well head, and any pipeline and top-side equipment used in the development or processing of hydrocarbons.

The precipitating material here referred to as "wax" as used within this document refers to solids that precipitate from fluids due to thermodynamically changes. These solids include solids typically dissolved in crude oil at well bore conditions such as asphaltenes, higher paraffins, hydrates, and inorganic and organic salts. The composition of the wax will depend on the origin of the fluid stream.

The "wax appearance temperature" is the highest temperature at which wax precipitation is observed. The exact temperature will depend on the fluid composition and pressure. However, a person skilled in the art can easily obtain this value for instance through simple experimentation.

The "bulk flow temperature" is the temperature of the fluid stream prior to the cooling step.

The present invention will be described in more detail with reference to the enclosed FIG. 1. The figure is a graph, depicting wax thickness over time with a change in temperature.

The basic idea of the present invention is based on the experimental findings described in example 1 (see below) and FIG. 1. It was discovered that it is possible to loosen already deposited wax from a pipe wall by increasing the wall temperature. The important point is to loosen the wax as solid parts, not melting the wax. Melting the wax would redissolve it in the flow and further on downstream deposit it again on the wall, which is undesirable. However, when the wax is ripped off from the wall as solid particles these can be transported downstream without deposition on the walls. The challenge is to find a way to cool down the stream, so that wax can precipitate but to ensure that this precipitated wax does not block the cooling zone. Instead the precipitated wax has to be continuously or periodically mixed into the stream. The method we propose for obtaining this is using pulsed heat.

The invention is based on using heat not to dissolve wax but to loosen wax thus enabling transport of wax as particles, which have no or very low tendency to be deposited on walls or other surfaces.

In a first aspect of the present invention the method can be applied to existing pipelines with Direct Electrical Heating installed. Instead of keeping the pipeline warm continuously, heating should be switched off as a standard. Only when the wax build-up has exceeded a certain limit, heating will be switched on for a short time. This will loosen the deposited wax which in turn will be transported downstream. To avoid too large amounts of wax loosened at the same time an additional improvement would be to switch on the heat not for a whole pipeline but only for a segment at a time. This would also clear fresh segments of pipeline for new deposit build-up which is important if only a part of an entire pipeline is used as a cooling zone and is equipped with heating capability. By securing a segment as the cooling zone, that always is available for deposit, deposits further downstream, where no heating means are installed, is avoided.

A heat pulse applied to pipeline, or any production equipment, leads to removal of deposited wax as solid particles without any significant re-dissolution of the wax in the hot well stream enabling cold flow for long distance transport.

a second aspect of the present invention for pipelines without electrical heating installed: It is necessary to install a heat exchanger to cool down the well stream before it enters the pipeline. Cold seawater can be used as cooling medium. All wax deposition will be limited to the heat exchanger.

The heat exchanger can be built in different variations: For example by having the hydrocarbon-carrying pipe suspended in free-flowing sea-water so that natural convection determines the cooling or by having an annulus filled with seawater around the hydrocarbon-carrying pipe or by another design.

There are two ways of keeping the heat exchanger or the free pipeline in the ground or surrounded by seawater clean using pulsed heat:

Using Electrical Heating:

Install electric heating capabilities. These might be either heating cables around the pipe, resistive heating in the pipe wall or inductive heating in the pipe wall. Heating will be normally switched off, but when wax build-up in the pipe exceeds a predefined limit or after a predefined time the heat will be switched on, loosening the wax which is transported away as solid parts with the fluid stream.

Figure 2:
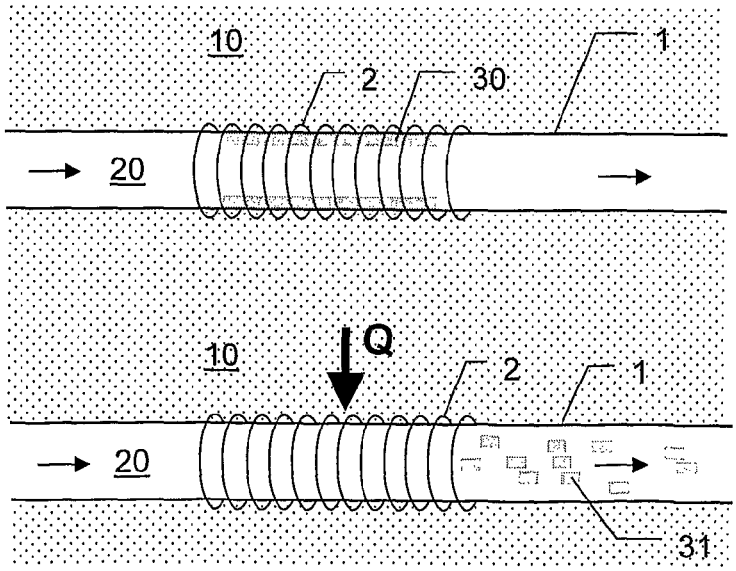
FIG. 2 depicts an embodiment of the invention wherein wax removal is accomplished with electrical heating.

FIG. 2 shows one embodiment of the invention using electrical heating. A pipe 1 surrounded by an environment 10, such as the ground or sea water which is colder than the temperature of the carried fluid 20, such as crude oil being transported at the bottom of the sea, is equipped with electrical heating 2 capability. By providing heat Q by an electrical pulse the deposited wax 30 is loosened and mixed and transported downstream as solid particles 31.

Using Hot Water:

During standard operation a heat exchanger will heat up sea water. If this hot water can be stored, it can be used periodically to flush the heat exchanger with hot water having the same effect as switching on electric heat. In that way no electric power supply is needed. In addition, flushing with hot water would remove/kill any organic deposition that might occur on the outside of the heat exchanger.

As an alternative, the heat exchanger can be flushed with any hot liquid (e.g. hot oil) that is available from other parallel processes.

Figure 3:
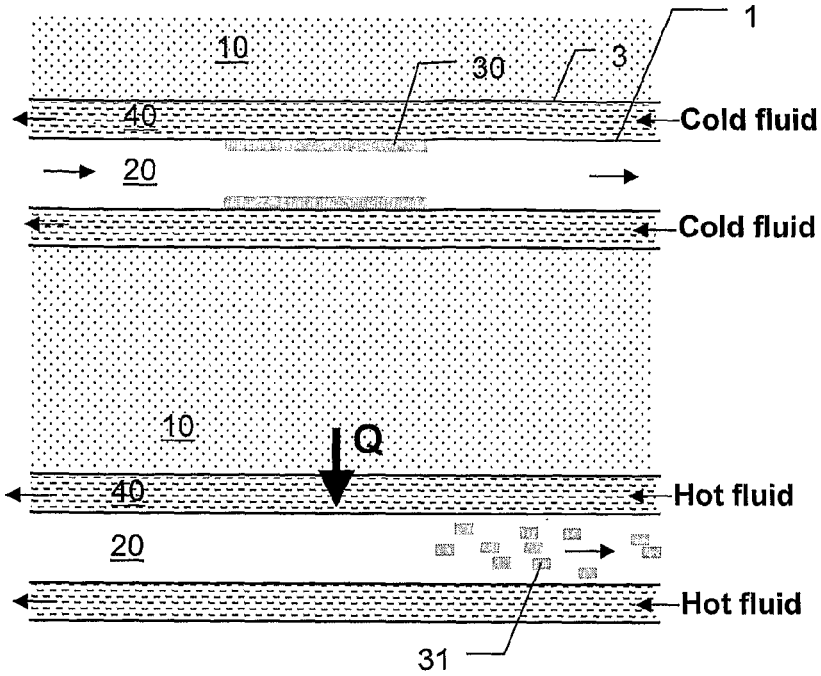
FIG. 3 depicts an embodiment of wax removal is accomplished with hot water.

FIG. 3 depicts one embodiment of this invention, accomplishing heating by a heat exchanger. A pipe 1 is surrounded by an annulus 3 wherein a heat exchange fluid 40, such as water, being colder than the temperature of the carried fluid 20, may circulate. By providing heat Q by hot fluid passing in the annulus 3, deposited wax 30 may be loosened and transported downstream as solid particles 31. The hot fluid maybe counter- or co-current with the pipe stream.

Due to high shear forces downstream of the electrical heating or heat exchanger, there is no tendency for re-deposition of loosened solid wax. Further, due to the lack of temperature gradient as the well stream temperature approaches the pipe wall and sea temperature, there is no deposit of dissolved wax molecules.

In the first aspect of the invention, for use with existing pipelines with direct electrical heating installed, the different heating regime described above will lead to a dramatic decrease of needed energy (>90%). In addition, should there be a problem with the new heating regime, there is always the fall-back solution of switching on the heating continuously to melt the wax, thus providing a safe way of keeping the pipeline open.

For the solution according to the second aspect of the present invention, with a heat exchanger, one advantage is that no installations in the flow path are necessary, as opposed to the solutions described in e.g. U.S. Pat. No. 6,070,417 or U.S. Pat. No. 6,656,366 B1.

For the option with electric heating, a further advantage is that there are no moving parts at all, which reduces failure possibilities.

For the option with hot fluid as heat medium, further advantages are that no external energy supply for heating is needed, and that hot fluid flushing cleans the heat exchanger from organic fouling.

In a third aspect, the invention can be used to clean wells: Depending on the reservoir condition and the well geometry, the fluid that is flowing from the reservoir through the well piping might cool below wax appearance temperature before reaching the opening of the well. In this case, wax will deposit inside the well piping, leading to the same negative consequences as described above for the subsea pipe case. Use of the present invention to remediate these instances of wax deposition is performed by installing a heating device around the well piping. As in the sub-sea pipeline case described above, this might be either an annulus that can be flooded by a hot liquid or an electric heating device. Then the same operating procedure of first cooling down the liquid and afterwards removing the deposit by an outside heat pulse can be applied which will result in a loosening of the deposit and a transport downstream of the loosened deposit.

In a fourth aspect, the invention can also be used to clean heat exchangers that are part of the top-side process equipment: These heat exchangers that are used for various process steps are subject to wax deposition whenever they cool down a wax-containing hydrocarbon stream below wax appearance temperature. To remove these deposits, the temperature of the cooling-medium in these heat exchangers has to be increased, leading again to a loosening of the deposit.

The following examples are included to illustrate the invention and they should not be interpreted as limiting for the scope of the patent which is defined by the claims.

Example 1

FIG. 1 shows the results from an experiment in a wax rig at StatoilHydro Research Centre, Porsgrunn, Norway: A waxy condensate is circulated at constant temperature (20° C.) through a rig. The rig is cooled from the outside by a water annulus.

During the first 17 days, the water in the annulus was at 10° C., stimulating a continuous build-up of wax in the rig.

After 17 days the water temperature was increased to 15° C. so that the temperature difference between condensate/water was reduced. This made the wax-build-up slower.

After 22 days the water temperature was increased to 20° C. so that the temperature between water and condensate was the same. After 1 day the wax that was previously deposited suddenly loosened and was transported downstream with the condensate. After stopping and opening the rig it was found to be clean without any wax at the walls.

An explanation for the loosening is that, while increasing the wall temperature the wax structure near the wall changes. This in turn reduces the adhesion forces that make the wax stick to the wall. When the adhesion forces become smaller than the turbulent shear forces the wax, will be ripped from the wall.

The heat pulse temperature may be any temperature higher than the bulk temperature. The higher the temperature the quicker the deposited wax is released. Hence, The heat pulse works best with temperatures above the wax melting temperature, but it should be noted that such high temperatures are not required as such, in order to remove wax. If high temperature are not available, such as due to low heating capacity, reduced power supply, or in order to save energy costs, lower temperature than the wax melting temperature may be used to provide loosening of wax deposits.

A coating of the inner pipe, at least in the heating zone, may be applied, in order to help initiate wax release or reduce the amount of heat required from for the heat pulse, or even to simply reduce the amount of wax formed.

Example 2

Saturn Cold Flow

Figure 4:
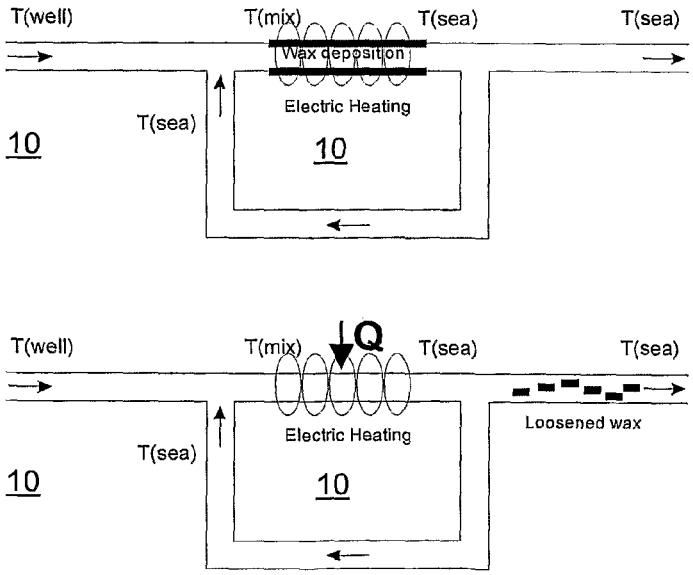
FIG. 4. depicts an embodiment of electrical heating is deployed in a recirculation stream.

The Saturn technology is, in short, a technique based on the idea that dry hydrate and wax particles can be transportable and non-agglomerating during flow and shut-down conditions, further described in WO 2004/059178. By recirculating a cold slip-stream of hydrocarbon fluids with hydrate/wax particles into the hot well stream as shown in FIG. 4, dry hydrate/wax particles should form by 'crash-cooling' as slurry particles in the bulk in a reaction zone in stead of precipitating on the wall, and the fluids are cooled to ambient temperature in the vicinity of the reaction zone. Hence no deposition on pipe walls and blockage should occur when the slurry particles are further transported with gas and oil for long distances, after the splitter.

However, if the recirculated cold stream is to be mixed with the warm well stream close to the production manifold, to avoid wax deposition and hydrate formation during shut-downs, the temperature close to the mixing point will be very high. The problem is that a mixing of a hot well stream and a cold stream of sea temperature will always result in a mixture with a temperature higher than sea temperature. It will therefore always remain necessary to cool down the mixture to sea temperature. This cooling down will always generate wax deposition in the cooling zone. Without proper remedies this will eventually block the pipe or heat exchanger.

By using the heat pulse wax removal method in the reaction zone of the Saturn flow system, or any downstream sections of the system, removal of such deposits is obtained.

As mentioned above, experiments show that it is possible to remove wax deposit from a pipe wall by increasing the wall temperature for a short time. This will reduce the adhesion force between pipe wall and deposit to such a degree that the deposit can be ripped from the wall. This does not melt the deposit. Instead the loosened wax is transported downstream in a solidified form that will not be deposited again.

Figure 5:
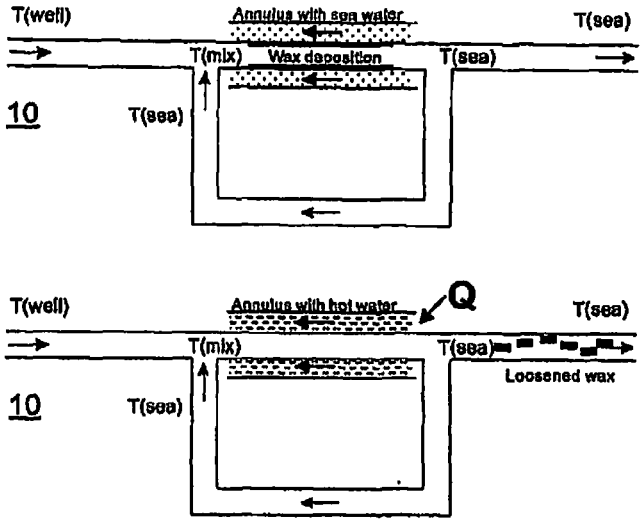
FIG. 5 depicts an embodiment of a heat exchanger is deployed in a recirculation stream.

This idea may also be used on the Saturn concept: The cooling zone or reaction zone, where wax deposition occurs is periodically exposed to a sharp heat pulse. As earlier mentioned, this heat pulse can be generated either:

- by direct electrical heat or by installing a heating cable (either inductive or resistive) as shown in FIG. 4, or;
- by hot water as shown in FIG. 5, where it is necessary to have an annulus installed around the cooling zone.

FIG. 4 illustrates how hot well stream of temperature T(well) is mixed with a stream that is cooled down to sea temperature T(sea). The resulting mixture has a mixture temperature T(mix) which is greater than T(sea). Therefore the mixture has to be cooled down further to sea temperature. In this cooling zone wax deposition will occur. In FIG. 4 the Saturn concept is combined with electric pulse heating: When wax deposition has reached a critical limit, electrical heating is switched on. Wax is not melted but loosens contact to the pipe wall and is then transported downstream.

The similar effect is obtained as shown in FIG. 5 by use of an annulus. Instead of cooling the mixture stream by surrounding sea water, an annulus with a forced stream of sea water is used as shown in the top drawing, which will additionally increase the cooling efficiency. In heat pulse mode, shown in the bottom drawing, the annulus will be flooded with hot water, which will loosen the deposit so it can be transported downstream. The annulus may be flooded in any suitable direction, either counter- or co-current with the well stream.

Figure 6:
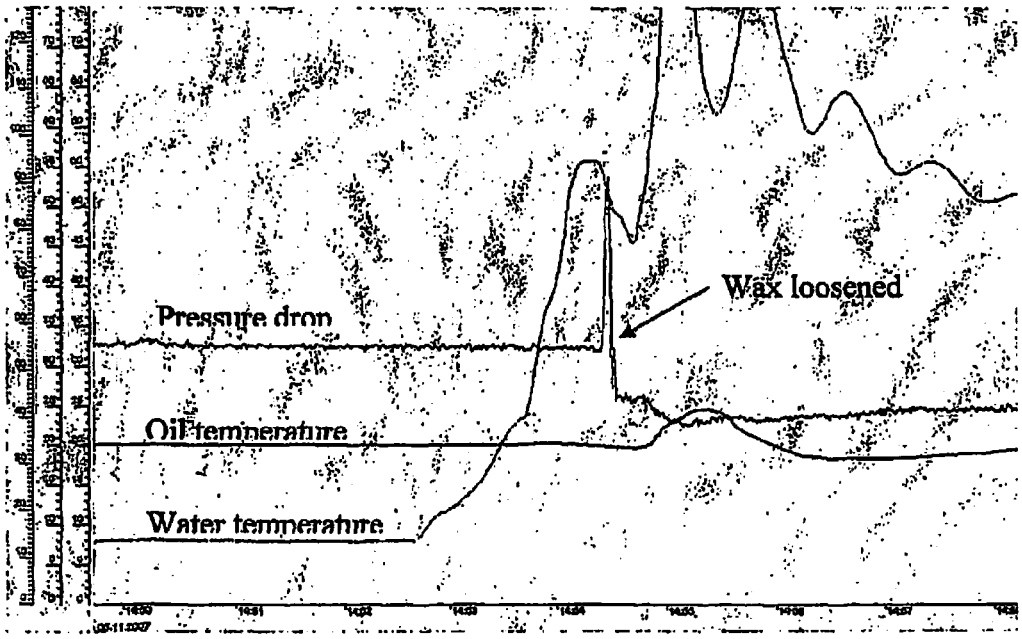
Fig. 6 (Prior Art)
FIG. 6 is a graph of water and oil temperature and pressure in a pipeline.

Experimental validation of the hot water concept is given with reference to FIG. 6. In a test loop, wax was deposited in a water cooled pipe. The wax thickness can be monitored by the pressure drop over the test section. The figure shows the sequence of events when increasing the water temperature in the annulus: The oil temperature is kept constant (20° C.). The water temperature is increased from 10° C. to over 50° C. After 2 minutes, the pressure drop shows a sharp spike and then decreases to a level that indicates that there is no longer wax present in the test section. The spike results from the wax deposit being transported downstream.

Figure 7:
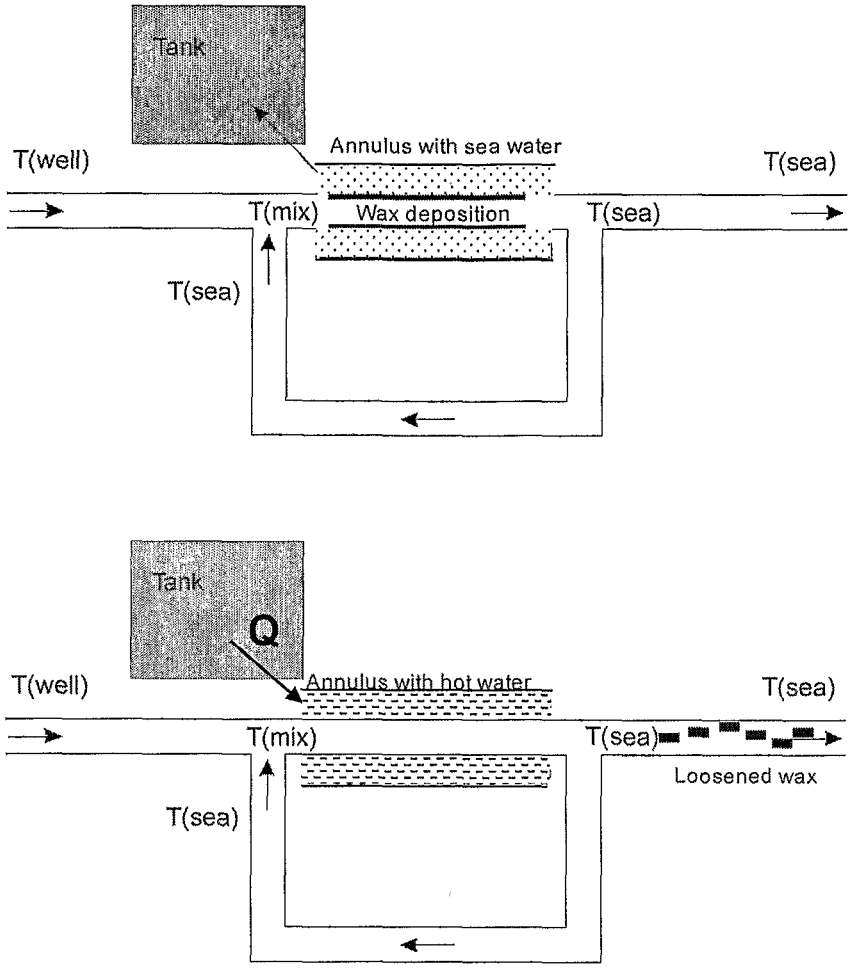
FIG. 7 depicts an embodiment of the invention including a heat exchanger and a storage tank.

As an extension to this idea, it is also possible to reuse the energy that is created while cooling down, by storing the created hot water from the heat exchanger in a tank, as shown in FIG. 7. This stored hot water is then used for the heat pulse. In the top drawing of FIG. 7, hot water generated during cool-down mode is stored in a tank. In the bottom drawing of FIG. 7, the stored hot water is reinjected into the annulus during heat-pulse mode.

Measurement of Wax Thickness

In a fourth aspect of the invention, the basic idea is to employ the fact that a wax deposit on a pipe wall is highly insulating to heat flow. So heat flow from the bulk fluid in the pipe to the surrounding of the pipe (or vice versa) will be reduced significantly in case of an existing wax deposit on the pipe wall.

Figure 8:
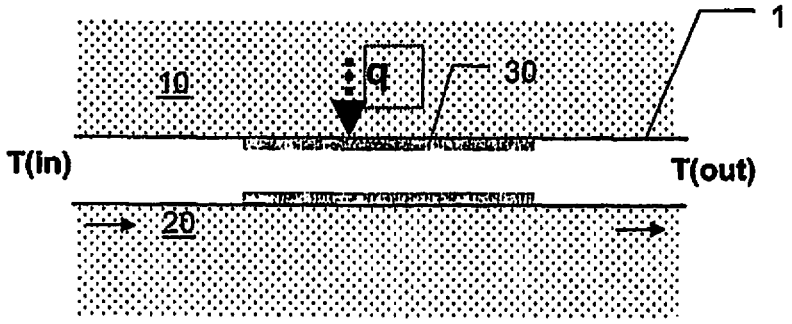
Fig. 8 (Prior Art)
FIG. 8 depicts temperature measurements of a fluid in a pipeline.

A short heat pulse q of shorter length than the heat pulse for wax removal is applied to the pipe section where the wax deposit thickness will be detected. During this operation, such as before and after the heat pulse, the fluid temperature going in, and the fluid temperature out, T(in)−T(out), of this section, is monitored as shown in FIG. 8.

Figure 9:
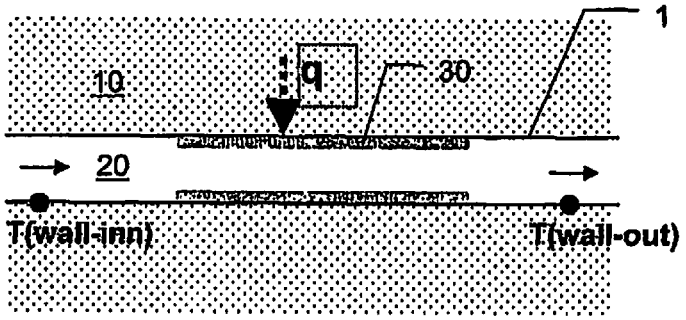
Fig. 9 (Prior Art)
FIG. 9 depicts temperature measurements of the walls of a pipeline.

Alternatively the difference in the (outer) wall temperature of the pipe is measured, T(wall-in)−T(wall-out), while applying an external heat pulse to a pipe section with wax deposit, so no intrusive sensors are needed as shown in FIG. 9.

Figure 10:
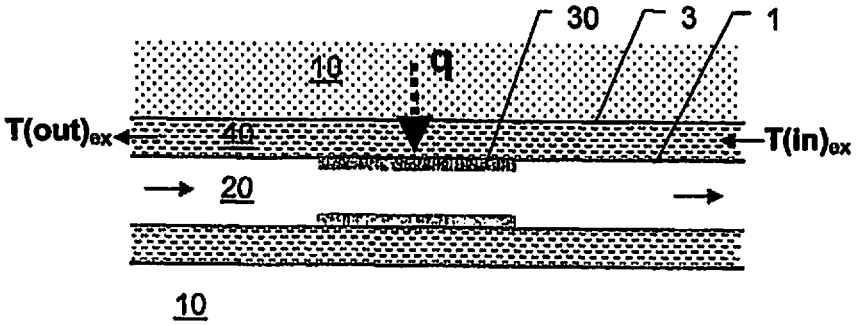
Fig. 10 (Prior Art)
FIG. 10 depicts temperature measurements of the fluid in an annulus.

In another alternative, the change in temperature difference of the water in an annulus used for heat pulse removal, such as the annulus shown in FIG. 10, is monitored instead of the actual fluid temperature or pipe temperature. The difference of T(in)ex−T(out)ex is calculated both before and after the short heat pulse and compared. The short heat pulse q is provided by electrical heating or by a short pulse of hot fluid in the annulus.

Knowing the geometry of the pipe, the fluid properties, the flow properties and the applied heat energy, it is possible to calculate the thickness of the insulating wax to match the measured temperature difference, with high accuracy.

Example 3

Figure 11:
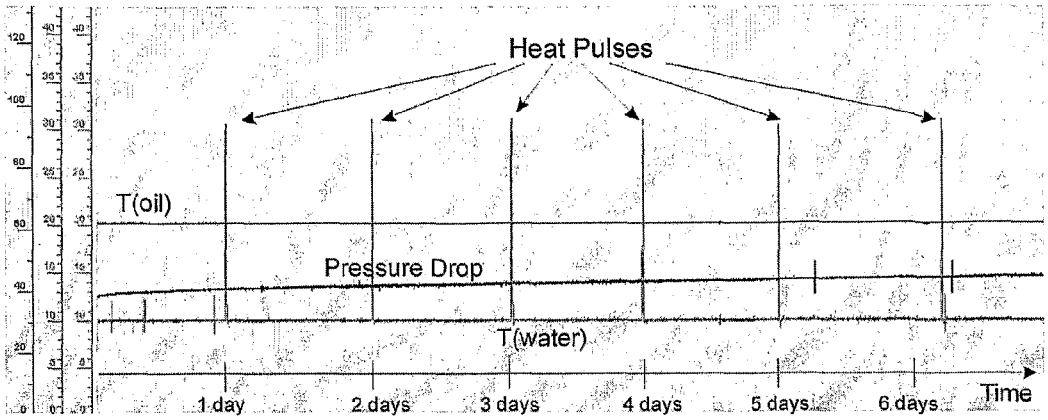
FIG. 11 is a graph of water and oil temperature and pressure drop in a pipeline over time together with heat pulses.
Figure 12:
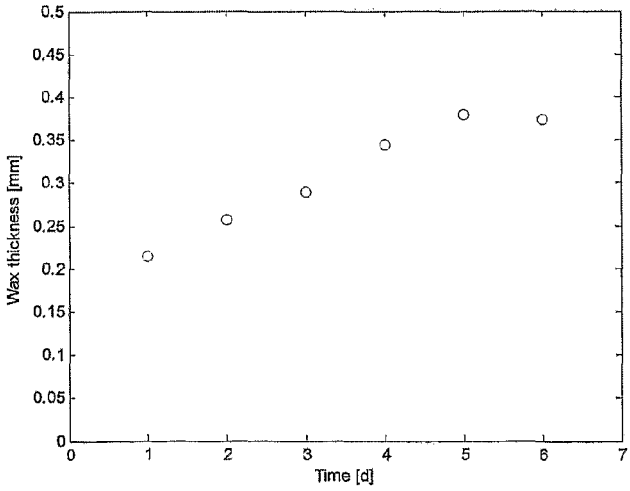
FIG. 12 depicts a graph of calculated wax thickness from daily performed heat pulses.

This principle has been proven in a wax rig, reference being made to FIGS. 11 and 12.

The heat pulse may be for example applied by an electric heating cable that is switched on for a short time or by a water annulus that is flooded with hot water for a short time. In the experiment shown in FIGS. 11 and 12, a temperature difference of only 10° C. between the oil and the water in the annulus was sufficient to provide reasonable results.

In this experiment, the temperatures were measured directly in the oil bulk flow. This is not desirable in a production environment. An alternative would be to measure the (outer) pipe wall temperature which provides the same information as shown in FIG. 12. In the alternative case of using hot water in an annulus, it is also possible to monitor the water temperature and the temperature drop from inlet to outlet during the heat pulse, as shown in FIG. 10.

Experiment performed in Wax Rig: Oil is circulated for one week at constant temperature (20° C.) through a test section. In an annulus around the test section cold water (10° C.) is circulated. The resulting temperature difference between the oil and the pipe wall results in a wax deposit that builds in the oil pipe. This is shown by the rising measured pressure drop. To test the idea proposed here, each day a short (5 minute)

heat pulse is performed by increasing the water temperature in the annulus to 30° C. The temperature difference in the oil (inlet vs. outlet) is recorded during these pulses (typically around 0.1° C.-0.3° C. for this setup).

Results from the experiment are shown in FIG. 12, as calculated wax thickness from daily performed heat pulses. Growth rate and final thickness correlate well with other measurements.

The methods of wax removal and wax thickness measurements according to the invention, provides non-invasive, relatively cheap, accurate and frequently usable methods for measurement and removal of wax deposit build-up, without any equipment in the main flow, thus still having a clear pig path.

In addition, wax deposit build-up can be measured:

frequently, e.g. daily, thus having clear control of wax thickness growth, and indication of the right moment for counter-action, such as wax removal by heat pulse, and cost-efficiently if the same process equipment, e.g. a water annulus, can be reused for the measurement purpose, with spatial dependency for longer pipe segments by measuring temperatures at intermediate points.

Wax thickness measurements of this kind can be used to decide whether a wax removal heat pulse as described above is necessary since the measurement heat pulse is carried out at the same point as the removal heat pulse.

The invention claimed is:

1. A method for removal of wax deposited on an inner wall in contact with a fluid stream wherein said stream contains dissolved wax, the method comprising:

(a) cooling the inner wall and the fluid stream to a temperature of, or below, the wax appearance temperature of said wax, to allow for dissolved wax to precipitate on the inner wall, and (b) thereafter bringing the deposited wax into the fluid stream, mainly in the form of solid parts, wherein the inner wall is heated to a temperature by pulse heating, where the deposited wax is released from the inner wall mainly in the form of solid parts and transported downstream by the fluid stream, and wherein the solid parts have little or no tendency to deposit on the inner wall.

2. The method according to claim 1, wherein said released solid parts are mixed into the stream.

3. The method according to claim 1, wherein the heating temperature is above a bulk flow temperature.

4. The method according to claim 1, wherein wax is chosen of any from the group comprising: solids that precipitate from fluids due to thermodynamic changes, solids dissolved in crude oil at well bore conditions, asphaltenes, higher paraffins, hydrates, and inorganic and organic salts and any mixture thereof.

5. The method according to claim 1, wherein the duration of the heating in step (b) is a pulse heating long enough to release deposited wax, and which is shorter than the precipitation step (a).

6. The method according to claim 1, wherein the duration of the heating in step (b) is a pulse heating long enough to release deposited wax, and which is shorter than the precipitation step (a), and wherein the pulse heating is repeated at regular intervals, or repeated on demand, according to a defined limit of wax thickness.

7. The method according to claim 1, wherein the inner wall is the inner wall of a pipeline, the well itself, the well head, or any pipeline and top-side equipment used in the development or processing of hydrocarbons.

8. The method according to claim 1, wherein the heating is performed at different times for different sections of a pipeline or a cooling zone thereof or different equipment type.

9. The method according to claim 1, wherein the inner wall is located in the ground, in sea water or inside a heat exchanger.

10. The method according to claim 1, wherein the cooling of the inner wall is performed by natural convection with the surroundings or by a forced fluid stream in an annulus of a heat exchanger surrounding the inner wall.

11. The method according to claim 1, wherein heating is performed by electrical heating by heating cables around a pipe, resistive heating or inductive heating in a pipe wall, or by a heat exchanger, by letting a warm fluid pass through the heat exchanger.

12. The method according to claim 1, wherein an apparatus containing said inner wall can be passed by a pig.

13. The method for removal of wax deposited on an inner wall in contact with a fluid stream according to claim 1, wherein the method is performed when a limit of wax thickness is reached, the wax thickness being measured by:

(a) performing a first temperature measurement upstream and downstream of a pipe section;

(b) applying a short heat pulse to the pipe section which does not loosen the deposited wax;

(c) performing a second temperature measurement upstream and downstream of the pipe section; and (d) calculating the thickness of the deposits from the change in temperature difference between the first and second temperature measurements.

14. The method according to claim 13, wherein wax thickness is measured regularly at predefined time intervals, which automatically initiate the removal method, the method being controlled by an automated control.

15. The method according to claim 1, wherein the inner wall is an inner wall of a pipeline, a well itself, a well head, or any pipeline, heat exchanger and top-side process equipment used in development or processing of hydrocarbons.

16. The method according to claim 13, wherein the short heat pulse is shorter than a short period of time needed to loosen the deposited wax.

17. The method according to claim 13, wherein the temperature measurements are chosen from: a temperature of a bulk flow; a temperature of a pipe wall; and the temperature of a fluid flowing in an annulus around the pipe.

* * * * *